United States Patent [19]

Meyers

[11] Patent Number: 4,781,318

[45] Date of Patent: Nov. 1, 1988

[54] TAGGING APPARATUS

[76] Inventor: Ronald L. Meyers, Rte. 2, Box 336, Sophia, N.C. 27350

[21] Appl. No.: 40,193

[22] Filed: Apr. 17, 1987

[51] Int. Cl.[4] ..... B65C 7/00; B31F 7/00

[52] U.S. Cl. ..... 227/67; 53/564; 493/376

[58] Field of Search ..... 53/564; 227/67, 18, 227/40, 481, 67; 493/376, 377

[56] References Cited

U.S. PATENT DOCUMENTS

| | | | |
|---|---|---|---|
| 3,598,025 | 8/1971 | Cotton | 493/376 X |
| 3,896,713 | 7/1975 | Mato | 493/376 X |
| 3,985,067 | 10/1976 | Livio et al. | 93/88 |
| 4,235,161 | 11/1980 | Kunreuther | 493/376 |
| 4,237,779 | 12/1980 | Kunreuther | 493/376 |
| 4,274,261 | 6/1987 | Sabel | 53/564 X |
| 4,315,587 | 2/1982 | Ritter et al. | 227/67 |

*Primary Examiner*—Paul A. Bell

*Attorney, Agent, or Firm*—Bell, Seltzer, Park & Gibson

[57] ABSTRACT

The apparatus includes at least one support unit and at least one tag supplying unit. The tag supplying unit includes a tag hopper and a tag conveyor and is mounted for multidirectional adjustive movement upon the support unit and relative to the needle of a fastener dispenser mounted at a fixed location upon the support unit. The apparatus may include a second tag supplying unit that is similarly mounted upon the support unit and is usable in association with the first tag supplying unit when a plurality of tags are to be secured to an article. When both tag supplying units are not needed, one may be removed from the support unit and mounted upon a second support unit to provide two separate tagging stations. The tag conveying means of each tag supplying means includes a suction head that is movable between the tag supply hopper and the dispenser needle along a sinuous path having an arcuate section extending downwardly and forwardly from the hopper, and another section extending substantially parallel to the dispenser needle.

20 Claims, 4 Drawing Sheets

TAGGING APPARATUS

This invention relates to apparatuses for securing tags to garments or similar articles by means of filamentary fasteners of the "bar-lock" or similar type. Such apparatuses are commonly referred to as "tagging apparatuses," and are so designated herein.

BACKGROUND OF THE INVENTION

Tagging apparatuses include, and may in their most rudimentary form consist exclusively of, a fastener dispensing gun or similar device having a hollow needle through which the fasteners are dispensed and onto which the articles to be tagged and the tags themselves are impaled. When the apparatus is of this most basic type, the operator manually effects impalement of the tags and articles upon the needle of the dispensing device, and then manually actuates the device to effect insertion of an interconnecting filamentary fastener through them. Although perhaps suitable for some occasional tagging operations, the foregoing manual technique is too slow, fatiguing and hazardous for high-production tagging operations, particularly those in which more than a single tag is to be attached to each article. In recognition of this fact, automatic tagging apparatuses have heretofore been proposed.

Illustrative of the previously proposed automatic tagging apparatuses is that disclosed in U.S. Pat. No. 4,235,161, issued Nov. 25, 1980 to Kunreuther and Beringhaus. Such apparatus includes means for mounting the fastener dispensing device in a fixed position, means for effecting automatic operation of the device in response to operator actuation of a readily accessible switch, and means for conducting tags from a supply hopper or the like to and onto the hollow needle of the dispensing device. In one embodiment the apparatus has two tag conveying assemblies that operate in sequence with each other to lessen the time required to secure a plurality of tags to each garment. An apparatus of the aforesaid automatic type can greatly increase the speed, efficiency and safety of the tagging operations, and therefore should significantly reduce the cost of such operations. However, this desirable result has not always been realized by the automatic tagging apparatuses heretofore commercialized, for a variety of reasons. Due to their size and/or complexity, such machines may be unduly expensive and difficult to manufacture, ship, assemble, adjust and/or maintain. Since adjustment of the apparatus is normally necessary not only during initial setup thereof, but also whenever there is a significant change in the size of the tags to be secured to the garments, a capability for rapid adjustment of the apparatus is particularly desirable. An additional disadvantage of those previously proposed "double" apparatuses having a pair of tag supplying mechanisms is that such mechanisms are both used only when a plurality of tags are to be secured to an article. When the tagging operation requires only a single tag per article, one of the tag conveying mechanisms remains unused and unusable. The economic wastefulness of this situation is aggravated if, as might well be the case, there is a concurrent need for another "single" tagging machine in the same plant where the only partially-used "double" machine is present.

With the foregoing in mind, a primary object of the present invention is the provision of a modular tagging apparatus that is of highly compact, efficient, economical and reliable construction, and that may be easily adjusted and/or modified to accommodate tags of differing size and/or to be uable in either single-tag or multiple-tag tagging operations.

SUMMARY OF THE INVENTION

The present invention provides a modular tagging apparatus realizing the objects hereinbefore noted, along with many practical benefits.

The apparatus includes at least one support unit upon which are mounted a fastener dispensing means, having an hollow needle through which the fasteners are dispensed, and conventional associated means for actuating the fastener dispensing means. The apparatus further includes at least one tag supplying unit that includes tag hopper means and tag conveying means for conveying tags from the hopper means to and onto the hollow needle of the fastener dispensing means. Releasable mounting means mount the tag supplying unit upon the support unit for multidirectional adjustive movement of the tag hopper means and the tag supplying means in unison with each other relative to the needle of the dispensing means; and also for rapid removal of the tag supplying unit from the base assembly when desired. When the apparatus is to be used for tagging operations wherein a plurality of tags are to be secured to each article, the apparatus further includes a second tag supplying unit that may be substantially the same as the first tag supplying unit and that is independently mounted in the same manner upon the base unit for multidirectional adjustive movement relative to the needle of the fastener dispenser and relative to the first tag supplying unit. At those times when a "double" tagging apparatus is not required, and there is a need for two "single" tagging apparatuses, one of the tag supplying units may be easily removed from the base unit, and connected to a second base unit to provide the two single units then needed.

In the preferred embodiment of the apparatus, each tag conveying means includes a suction-type tag gripper that is movable to and fro between the tag hopper means and the needle of the fastener dispensing means along a path of travel having a first section extending in arcuate fashion downwardly and forwardly from the hopper toward the needle, and another section extending substantially vertically parallel to the needle axis. The means by which the gripper is mounted for such movement preferably includes both toggle linkage means and associated cam means in the form of a sinuous cam track and a cooperating cam follower.

DESCRIPTION OF THE DRAWINGS

Other features of the invention will be in part apparent from the following description of an illustrative embodiment thereof, which should be read in conjunction with the accompanying drawings, in which.

DESCRIPTION OF THE PREFERRED EMBODIMENT

Figures 1, 2:
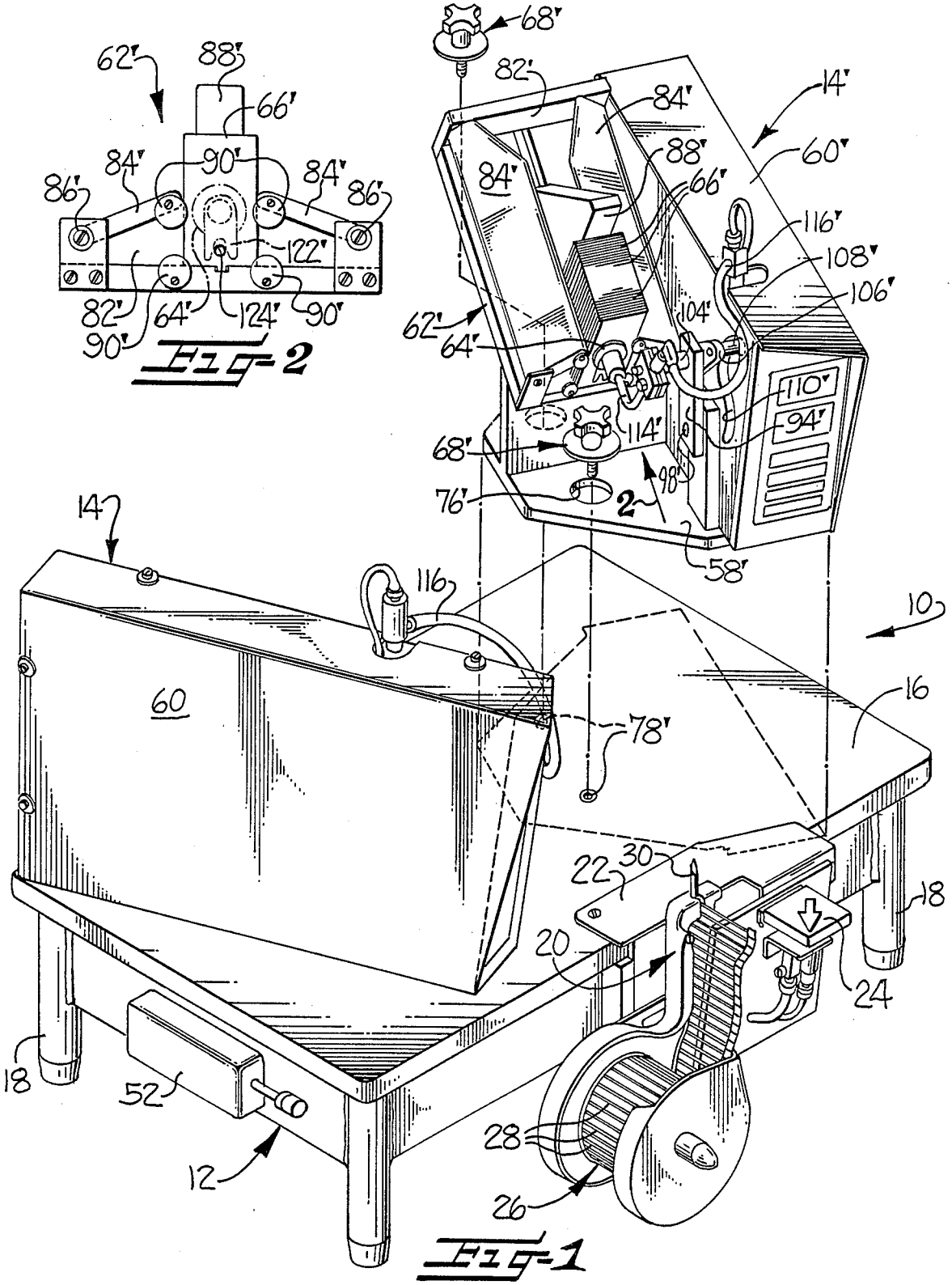
FIG. 1 is a partially exploded front perspective view of a "double" type of tagging apparatus in accordance with the invention.
FIG. 2 is an end view looking in the direction of the arrow 2 of FIG. 1 of the tag hopper of the right tag supplying unit of the apparatus, and also showing a tag within the hopper and a phantom line representation of the tag gripping suction head of the tag conveying means of the unit.
Figure 3:
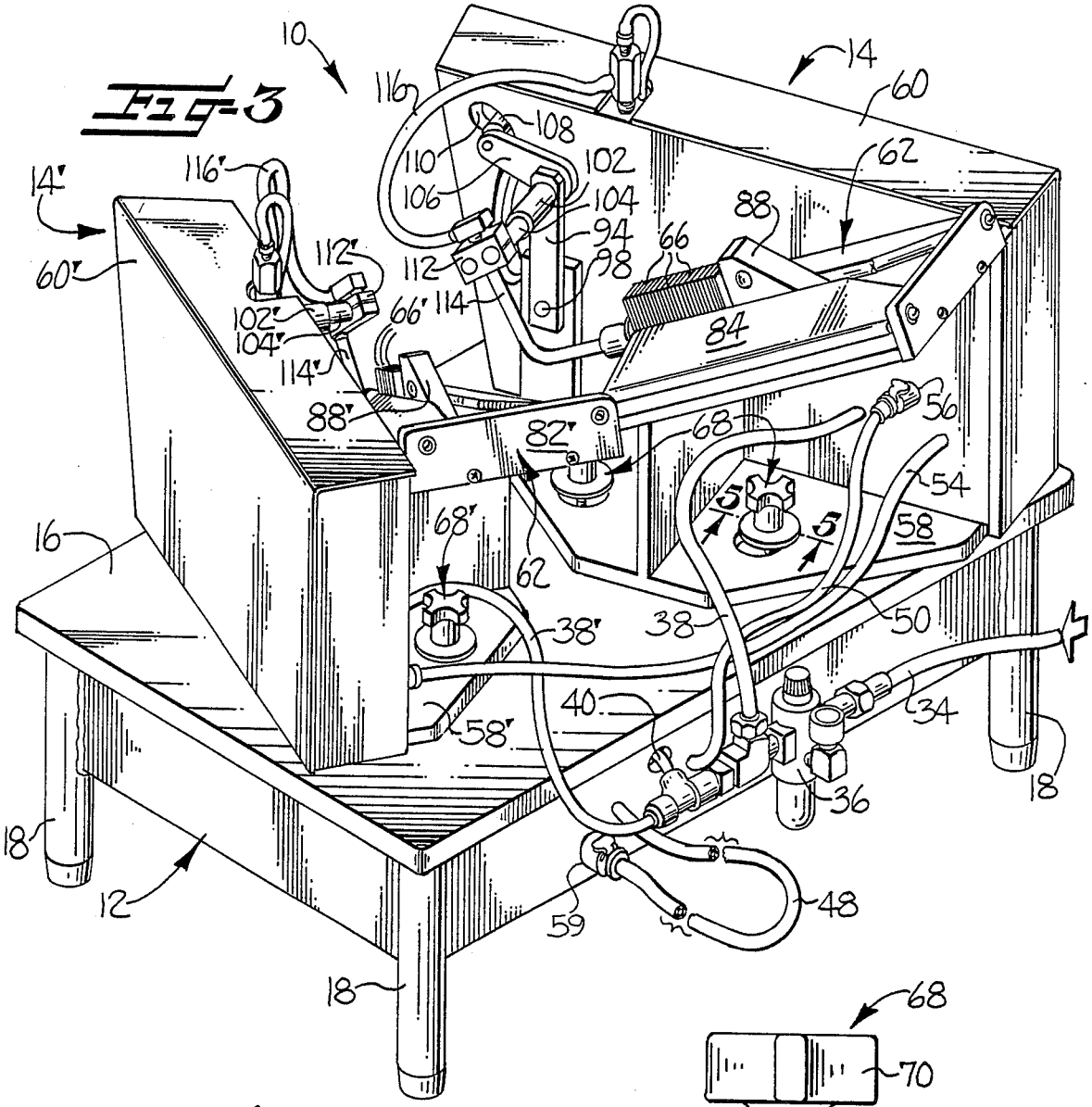
FIG. 3 is a rear perspective view of the apparatus of FIG. 1.

In the form thereof shown in FIGS. 1 and 3 of the drawings, the modular tagging apparatus 10 includes a single base or support unit 12, a left-hand tag supplying unit 14 and a right-hand tag supplying unit 14'. Since units 14, 14' differ only in that they are opposite-hand mirror images of each other, and in that unit 14 may be and illustratively is of a smaller size than unit 14', components of unit 14 that correspond to components of unit 14' are designated in the drawings by the same reference numerals with the addition of a prime symbol.

Figure 8:
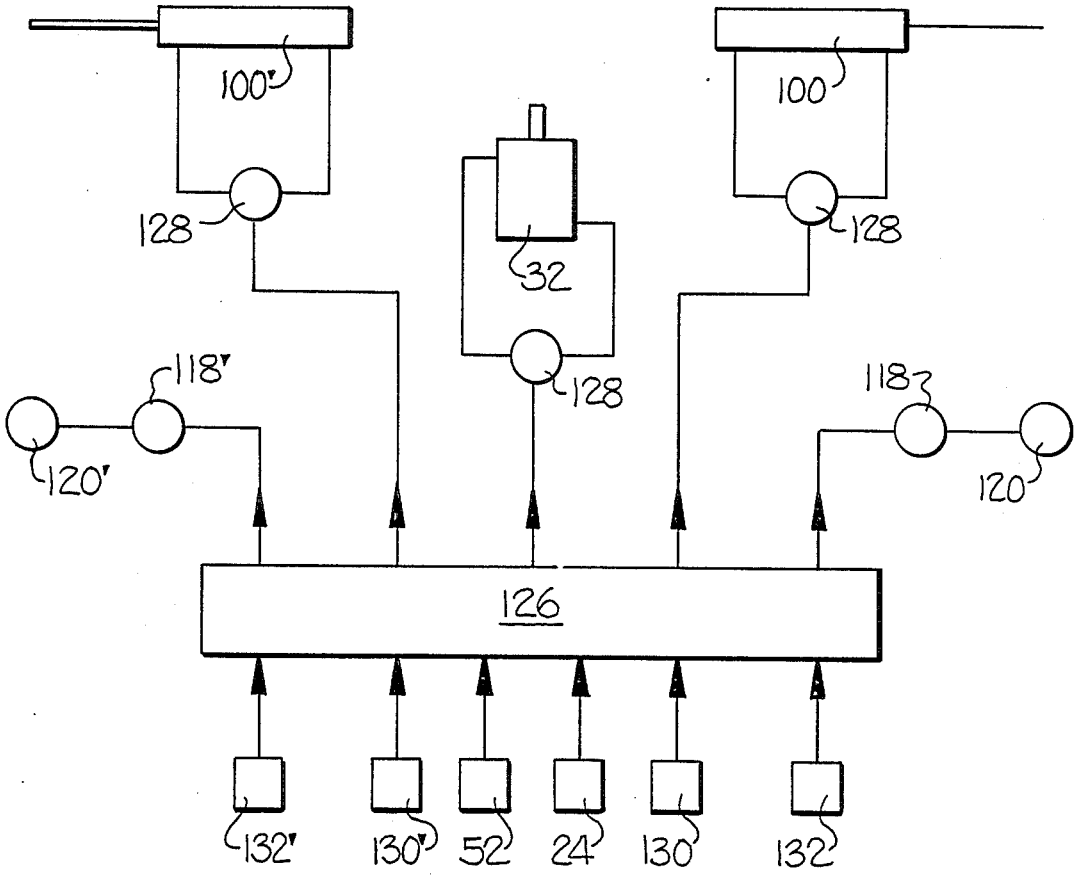
FIG. 8 is a diagrammatic representation of actuator, valve and other control components of the apparatus.

Support unit 12 is generally of table-like construction, having a horizontally extending top 16 underlaid by legs 18. A conventional fastener dispensing device 20 is mounted adjacent the front edge of top 16 of unit 12 by bracket means 22 that also carries a spring biased switch element 24. A reel 26 associated with faatener dispenser 20 carries a supply of filamentary fasteners 28 that are illustratively of the well-known "bar-lock" type. Whenever dispenser 20 is actuated, one of the fasteners 28 is dispensed through the vertically extending hollow needle 30 of the dispenser and through whatever is then impaled upon such needle. Actuation of dispenser 20 occurs in response to operator depression of switch 24. This causes activation of a pneumatic actuator 32 that is schematically shown in FIG. 8 of the drawings and that is mounted beneath top 16 of unit 12 and operatively connected to the trigger component (not shown) of dispenser 20.

Compressed operational air for actuator 32 and other components of apparatus 10 is conducted to the rear of unit 12 via a flexible conduit 34 from a suitable pressurized-air source (not shown). The air from conduit 34 passes through a combined pressure regulator and filter 36 and various fittings to a plurality of parallel branch conduits 38, 40, 38', also of a flexible type. Conduit 40 conducts pressurized air via suitable control valve means to the actuator 32 that operates filament dispenser 20 of unit 12. Conduits 38, 38' respectively lead to tag supplying units 14, 14' and are releasably connected thereto by means of quick connect/disconnect couplings which may be of the known type shown in FIG. 4 of the drawings. Connection of each FIG. 4 coupling is made simply by introducing its male component 42 into its female component 44. This automatically locks the components together, and at the same time opens a normally-closed check valve (not shown) associated with male coupling component 42 so as to permit flow through it. Disconnection of the coupling can be accomplished with equal speed and facility simply by depressing a spring-biased element 46 of female coupling component 44, and then removing male component 42 therefrom. This also results in automatic closure of the check valve associated with male component.

Figure 4:
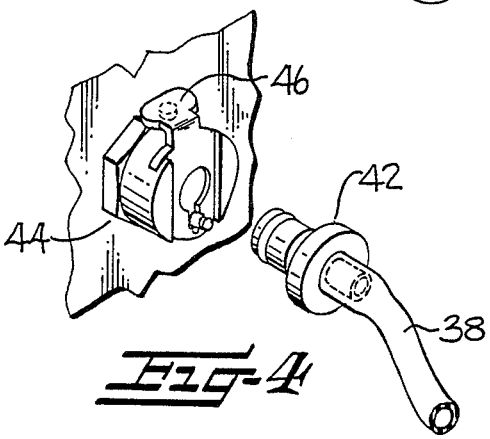
FIG. 4 is an enlarged fragmentary perspective view of quick connect/disconnect coupling components used in the apparatus.
Figure 5:
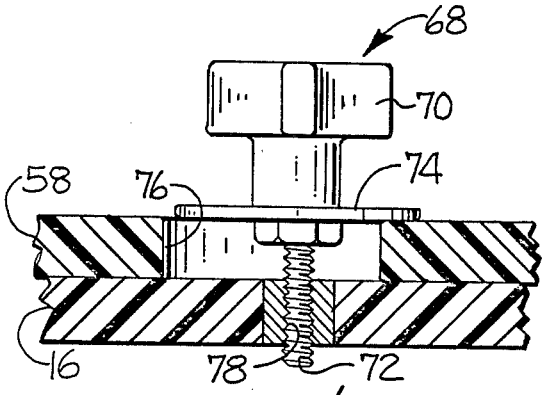
FIG. 5 is a partially sectional and partially elevational view, taken substantially along the line 5—5 of FIG. 3, of releasable means used for mounting the tag supplying units upon the base unit for adjustive and other movement relative thereto.

Another flexible conduit 48 extends from switch 24 of unit 12 and is illustratively connected, by a coupling of the FIG. 4 type, to a pneumatic-signal inlet port 58 connected to the pneumatic actuator 32 that operates fastener dispenser 20. Such arrangement results in operation of dispenser 20 immediately upon operator actuation of switch 24. Still another flexible conduit 50 leading from unit 12 is connectable, by a coupling of the FIG. 4 type, to the signal inlet port 56 or 56' of either tag supplying unit 14 or 14', and illustratively to the former. Conduit 50 is connected to dispenser actuator 32 and to an adjustable timer 52 (FIG. 1) carried by a support unit 12. When conduit 50 is connected as shown to tag supplying unit 14, it causes a cycle of operation of unit 14 to be initiated a selected timed interval after each actuation of fastener dispenser 20 by actuator 32. Each tag supplying unit 14, 14' also has a respective flexible conduit 54, 54' that may be connected, by a coupling of the FIG. 4 type, to either the signal input port 56, 56' of the other unit, or to the signal input port 58 associated with the pneumatic actuator 32 connected to the fastener dispenser 20 carried by unit 12. In the illustrative arrangement shown in FIG. 3, the signal output conduit 54 of unit 14 is connected to the signal input port 56' of unit 14'. This arrangement results in automatic initiation of a cycle of operation of tag supplying unit 14' following each cycle of operation of tag supplying unit 14.

Since tag supplying units 14, 14' are substantially identical, only one of them will be described in detail, and it will be understood that such description applies equally well to both units.

Tag supplying unit 14' includes a flat base 58', an upstanding housing 60' connected to and extending upwardly from one side portion of base 58', an inclined tag supply hopper 62' connected to base 58' and housing 60', and tag conveying means including a suction head 64' for conducting tags 66' from hopper 62' to and onto hollow needle 30 of fastener dispenser 20. Base 58' rests upon the upper surface of top 16 of unit 12 and supports unit 14' for universal adjustive movement relative to unit 12 in all directions parallel to the plane of top 16. Unit 14' may be quickly and easily secured in any desired one of its many possible adjustive positions by a pair of clamping assemblies 68'. Each assembly 68' includes an operating knob 70' from which depends a threaded shaft 72' encircled adjacent its upper end portion by an annular clamping plate 74'. The threaded shaft 72' of each clamping assembly 68' extends freely through the therewith-aligned one of a pair of enlarged bores 76' provided in base 58' of unit 14', and thence into the therewith aligned one of a pair of threaded bores 78' provided in top 16 of support unit 12. Unit 14' is secured in a desired adjustive position when operator rotation of knobs 70' in the appropriate direction causes its base 58' to be clamped between the overlying plates 74' and the underlying top 16 of unit 12. Rotation of knobs 70' in the opposite direction to a limited extent permits adjustive movement of unit 14' to another adjustive position thereof, when desired. Continued rotation of knobs 70' in the latter direction effects complete withdrawal of shaft 72' from threaded bore 78' and thus permits displacement of unit 14' from top 16 of unit 12. Complete disassociation of unit 14' from unit 12 and also from unit 14 may at the same time be effected by releasing the quick-release couplings associated with the flexible conduits interconnecting unit 14' with the other units.

Tag supply hopper 62' of unit 14' has an inclined bottom wall 80', a rear wall 82', and a pair of pivotally adjustable side walls 84' that are releasably secured in desired adjustive pivotal positions by screws 86' respectively associated therewith. When in their proper adjustive positions illustrated in FIG. 2, the free longitudinal edge portions of side walls 84' lightly engage opposite side edges of the stack of tags 66' centrally located within hopper 62'. A weight 88' slidable upon hopper bottom wall 80' rearwardly of tags 66' tends to advance them toward the forward open end of hopper 62'. The forwardmost tag of the stack is prevented from exiting hopper 66', until positively withdrawn therefrom, by disk-like retainer elements 90'. Elements 90' are carried by the forward edges of side walls 84' and bottom wall 80' of the hopper, and are adjustively movable to positions, such as shown in FIG. 2, wherein they project to a slight extent into overlying engagement with the forward surface of the forwardmost tag 66'. A small amount of flexure of the edge portions of each forwardmost tag permits the same to be withdrawn from hopper 62', when desired, by the tag conveying means of unit 14'.

Figure 6:
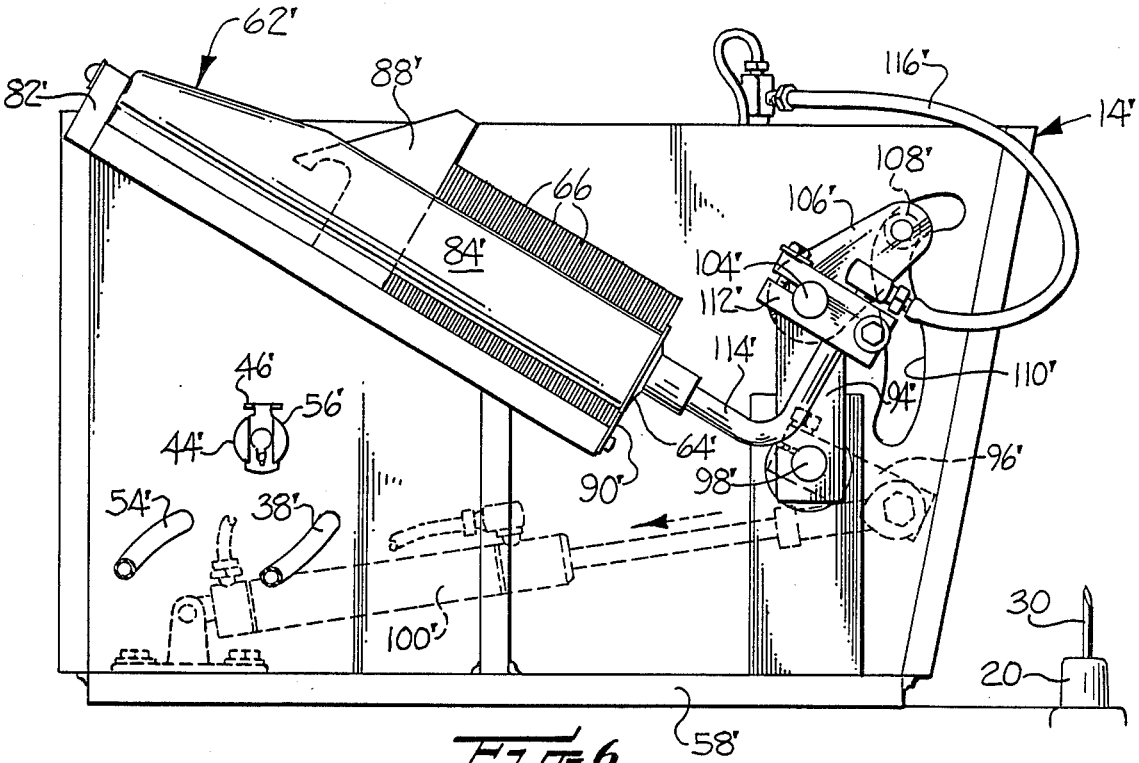
FIG. 6 is a side elevational view of the right tag supplying unit and of the upper portions of the base unit and fastener dispenser, showing the vacuum head of the tag conveying means in its tag receiving position.
Figure 7:
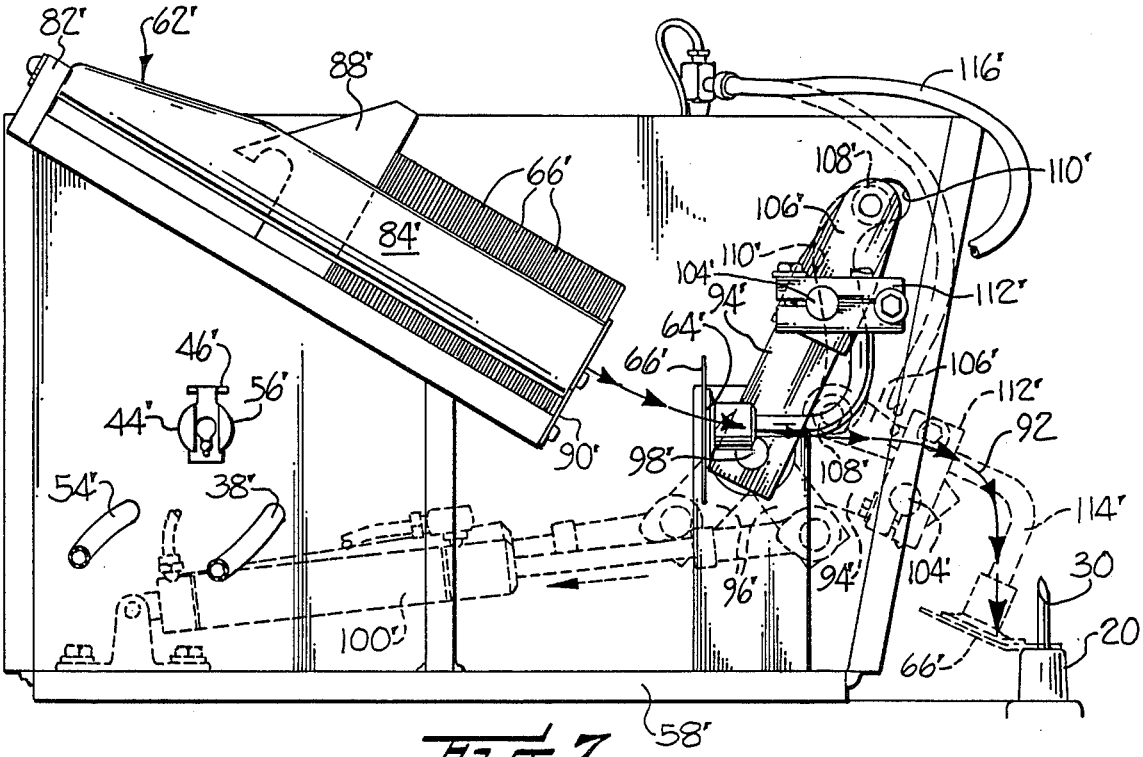
FIG. 7 is a view similar to FIG. 6 wherein the vacuum head is shown by solid lines in an intermediate position along its path of travel, and by phantom lines in its tag discharging position.

The tag conveying means of unit 14' includes a flexible and resilient suction head 64' that, during each cycle of operation of the unit, engages and "grasps" (by suction forces) the then forwardmost tag 66' in supply hopper 62'. FIGS. 1, 2 and 6 of the drawings show suction head 64' in the position occupied by it immediately after engaging and grasping such a tag. Suction head 64' and the tag 66' grasped by it then undergo movement along the sinuous path of travel 92 indicated by the aligned arrows in FIG. 7. Such path of travel includes an initial section that extends downwardly and forwardly from hopper 62', a terminal portion extending generally vertically in substantially parallel relationship to needle 30 of fastener dispenser 20, and an intermediate section that extends generally horizontally between the aforesaid initial and terminal sections. Suction head 64' is mounted for movement to and fro along the aforesaid path of travel by mounting means to be now described. Such means includes a bell-crank member having upper and lower sections 94', 96' affixed to opposite end portions of a horizontally extending pivot pin 98' that projects through and is mounted by a suitable bearing (not shown) carried by the inner side wall of housing 60' of unit 14'. Lower section 96' of the bell crank member is disposed within housing 60', along with a linear pneumatic actuator 100' whose rod component is pivotally connected to bell crank section 96'. The other bell crank section 94', which is disposed exteriorally of housing 60', has at its upper end a bearing or bushing 102' through which extends a rotatable pin 104'. The end of pin 104' adjacent housing 60 is fixedly connected to a toggle link 106'. The opposite, free end of toggle link 106' carries a cam follower 108' that is received within a sinuous cam track 110' carried by or, as shown, formed within the adjacent vertical wall of housing 60'. The end portion of pin 104' that is distal from housing 60' carries a bracket 112' that fixedly secures to the pin one end portion of a hollow L-shaped arm 114'. The aforesaid end portion of arm 114' is connected by a flexible conduit 116' to a venturi-type of vacuum pump 120' (FIG. 8) located within housing 60' of unit 14'. Pump 120' is in turn connected to a control valve 118' (FIG. 8). Suction head 64' is mounted upon the opposite end of arm 114' and, in response to extension and retraction of pneumatic actuator 100', undergoes movement to and fro along the arcuate path of travel 92 (FIG. 7) previously described. The suction forces present at other times within suction head 64' are interrupted by valve 118' after the suction head has impaled each tag 66' upon needle 30 of fastener dispenser 20, as indicated by phantom lines in FIG. 7, so that the tag remains upon needle 30 as suction head 64' undergoes return upward movement away from the needle.

As is indicated in FIG. 2 by phantom lines, generally V-shaped backing member 122' may if desired be provided in association with suction head 64'. The backing member permits a tag 66' to be successfully impaled upon dispenser needle 30 even if the hole 124' should not be completely formed through the tag.

When apparatus 10 is used to secure two tags to a garment or similar article during each tagging operation, it may be adjusted to cause either desired one of the units 14, 14' to place the first tag upon needle 30, and/or to cause the tags to be placed on opposite sides of the article being tagged, or to cause both tags to be placed on the same side of the article. Such adjustments can be quickly and easily effected simply by appropriately changing the connections of the conduits 48, 50, 54 and/or 54' with the signal inlet ports 59, 56 and/or 56' of the units 12, 14 and 14'. Adjustments to accommodate changes in the size of the tags can be similarly effected with ease and speed by adjusting the sides of tag hoppers 62 and/or 62', and the positions of the units 14 and/or 14' upon top 16 of unit 12. The proper adjusted position of either unit 14 or 14' may be easily determined simply by extending its tag transferring mechanism and a tag gripped thereby to the tag discharging position shown by phantom lines in FIG. 7, then moving the entire unit 14 or 14' in question to a location upon support top 16 in which the tag is properly impaled upon fastener dispenser needle 30, and then securing the unit in place by rotation of its clamping knobs 70 or 70'.

If only a single tag is to be secured to a garment during each tagging operation, either unit 14 or unit 14' may be removed completely from support unit 12 and used, in association with another unit 12 identical to that shown or of a smaller size, to provide a second tagging station that may be operated simultaneously with but independently of the first tagging station at either the same location or at some different location. Additionally, if either unit 14 or 14' should begin to malfunction, it can be quickly removed from apparatus 10 for repair, either on the premises of the apparatus user or that of the manufacturer, and pending such repair another unit may be substituted for it.

FIG. 8 of the drawings schematically indicates how control means 126 of apparatus 10 controls the valves 128 that direct pressurized air to and from opposite ends of linear actuators 32, 100, 100'; and also controls the operation of the valves 118, 118' that regulate the suction force in suction heads 64, 64'. Control means 126 receives input from adjustable timer 52 and from the operator-actuable switch 24 upon support unit 12. It also receives inputs from vacuum-force adjustment devices 130, 130' and from run/set-up switches 132, 132' respectively provided in association with units 14, 14'. When either switch 132 or 132' is in its "set-up" position, would, when provided, permit suction head of the unit in question to be manually moved to and maintained in its tag-discharging position during initial set-up of the apparatus or during subsequent adjustive movement of the unit 14 or 14' relative to support unit 12. It will be noted that the aforesaid adjustments can be made rapidly and correctly by an ordinary operator of the apparatus, without the use of any tools whatsoever and without the assistance of a mechanic or other technically trained person.

While a specific embodiment of the invention has been shown and described, this was for purposes of illustration only, and not for purposes of limitation, the scope of the invention being in accordance with the following claims.

I claim:

1. In a tagging apparatus for securing tags by filamentary fasteners to an article, said apparatus including a tag supply hopper, a fastener dispensing device having a hollow needle-like member upon which tags are adapted to be impaled and through which fasteners are dispensed, and a suction-head member adapted to grasp a tag at said hopper and to impale said tag upon said needle-like member, the improvement comprising:

mounting means mounting said suction-head member for movement along a sinuous path of travel having an initial arcuate section extending downwardly and forwardly from said hopper means and a terminal approximately linear section extending generally parallel to said needle-like member.

2. Apparatus as in claim 1, wherein said needle-like member is substantially vertical, and said path of travel further includes a generally horizontally extending section intermediate said initial and terminal sections.

3. Apparatus as in claim 1, wherein said mounting means includes a cam track and a cam follower.

4. Apparatus as in claim 1, wherein said mounting means includes a toggle linkage.

5. In a tagging apparatus for securing tags by filamentary fasteners to an article, said apparatus including a tag supply hopper, a fastener dispensing device having a hollow needle-like member upon which tags are adapted to be impaled and through which fasteners are dispensed, and a suction-head member adapted to grasp a tag at said hopper and to impale said tag upon said needle-like member, the improvement comprising:

mounting means mounting said suction-head member for movement along a sinuous path of travel having an initial arcuate section extending downwardly and forwardly from said hopper means and a terminal approximately linear section extending generally parallel to said needle-like member, said mounting means including a cam track and a cam follower and a toggle linkage.

6. Modular tagging apparatus for securing tags of differing configurations to an article by filamentary fasteners, comprising:

at least one support unit;

fastener dispension means carried by said support unit, said dispensing means having a hollow needle-like member upon which tags and articles are adapted to be impaled and through which the fasteners are adapted to be dispensed;

first and second tag supplying units, each of said tag supplying units including hopper means for storing a plurality of tags, and tag conveying means for conveying tags from said hopper means to an onto said needle-like member of said fastener dispensing means;

first and second mounting means adjustably mounting respective ones of said first and second tag suplying units upon said support unit for rapid universal adjustive movement, by an operator of the apparatus and in whichever ones a plurality of different directions as compensates for tag-configuration variation, parallel to a supporting surface of said support unit;

said adjustive movement of each of said tag supplying units effecting movemlent of the therewith associated ones of said hopper means and said tag conveying means in unison with each other relative to said needle-like member of said dispensing means and relative to the other of said tag supplying units;

said mounting means also mounting each of said tag supplying units for rapid removal from said support unit when desired;

said tag conveying means of each of said units including suction-head means adapted to engage and grasp successive tags at said hopper means of said unit, and suction-head mounting means mounting said suction-head means for bidirectional movement along a sinuous path of travel having a first arcuate section extending forwardly and downwardly from a tag pick-up location adjacent said hopper means of said unit, a second section extending gernerally parallel to said needle, and a generally horizontally extending third section intermediate said first and second sections;

said suction-head mounting means of each of said units including a shaft mounted for oscillatory movement about its central axis, drive means for imparting said movement at desired times to said shaft, a toggle assembly connected to said shaft, and cam means operatively associated with said toggle assembly.

7. Apparatus as in claim 6, wherein each said toggle assembly includes a pair of toggle links and an interconnecting pin member, and each said suction-head mounting means further includes a suction-head support arm connected adjacent one end to said pin member and connectd adjacent its opposite end to said suction head of the associated one of said units.

8. Apparatus as in claim 7, wherein each said cam means includes a cam follower connecting to and extending from one of said toggle links of said toggle assembly of the associated one of said units.

9. Apparatus as in claim 8, wherein each said cam means further includes a sinuous cam track cooperable with said cam follower of the associated one of said units.

10. Apparatus as in claim 9, wherein each said drive means includes a pneumatic linear actuator connected to said shaft of the associated one of said units.

11. Modular tagging apparatus for securing tags of differing configurations to an article by filamentary fasteners, comprising:

at least one support unit;

fastener dispensing means carried by said support unit, said dispensing means having a hollow needle-like member upon which tags and articles are adapted to be impaled and through which the fasteners are adapted to be dispensed;

at least one tag supplying unit, said tag supplying unit including hopper means for storing a supply of tags, and tag conveying means for conveying tags from said hopper means to and onto said needle-like member of said fastener dispensing means;

and means adjustably mounting said tag supplying unit upon said support unit for rapid adjustive movement, by an operator of the apparatus and in whichever ones of a plurality of different directions as compensates for tag-configuration variation, of said hopper means and said tag conveying means in unison with each other relative to said needle-like member of said dispensing means.

12. Apparatus as in claim 11, wherein said mounting means includes rapidly engageable and disengageable clamping means for in a partially engaged condition permitting universal adjustive movement of said tag supplying unit parallel to a supporting surface of said support unit, and for in a fully disengaged condition permitting rapid removal of said tag supplying unit from said support unit.

13. Apparatus as in claim 12, and further including a second tag supplying unit, and second mounting means mounting said second unit upon said support unit for multidirectional adjustive movement of the tag hopper means and the tag conveying means of said second unit in unison with each other relative to said needle of said fastener dispensing means and relative to said first-mentioned tag supplying unit.

14. Apparatus as in claim 13, wherein said tag conveying means of each of said units includes suction-head means adapted to engage and grasp successive tags at said hopper means, and mounting means mounting said suction-head means for bidirectional movement along a sinuous path of travel having a first arcuate section extending forwardly and downwardly from a tag pick-up location adjacent said hopper means, and a second section extending generally parallel to said needle.

15. Apparatus as in claim 14, wherein said path of travel includes a generally horizontally extending third section intermediate said first and second sections.

16. Apparatus as in claim 15, wherein said means mounting said suction-head means includes a shaft mounted for oscillatory movement about its central axis, drive means for imparting said movement at desired times to said shaft, a toggle assembly connected to said shaft, and cam means operatively associated with said toggle assembly.

17. Apparatus as in claim 16, wherein said toggle assembly includes a pair of toggle links and an interconnecting pin member, and further including a suction-head support arm connected adjacent one end to said pin member and connected adjacent its opposite end to said suction head.

18. Apparatus as in claim 17, wherein said cam means includes one of said cam follower connecting to and extending from a toggle links of said toggle assembly.

19. Apparatus as in claim 18, wherein said cam means further includes a sinuous cam track cooperable with said cam follower.

20. Apparatus as in claim 19, wherein said drive means includes a pneumatic linear actuator connected to said shaft.

* * * * *

UNITED STATES PATENT AND TRADEMARK OFFICE

CERTIFICATE OF CORRECTION

PATENT NO. : 4,781,318

DATED : NOVEMBER 1, 1988

INVENTOR(S) : RONALD L. MEYERS

It is certified that error appears in the above-identified patent and that said Letters Patent is hereby corrected as shown below:

Column 1, lines 30-31, "Beringhaus" should read --Beringhause--.

Column 3, line 37, "faatener" should read --fastener--.

Column 8, line 13, "movemlent" should read --movement--.

Column 10, lines 23-24, "includes one of said cam follower connecting to and extending from a" should read --includes a cam follower connecting to and extending from one of said--.

Signed and Sealed this

Twenty-fifth Day of April, 1989

*Attest:*

DONALD J. QUIGG

*Attesting Officer*

*Commissioner of Patents and Trademarks*